US005281181A

United States Patent [19]

McCollum

[11] Patent Number: 5,281,181

[45] Date of Patent: Jan. 25, 1994

[54] CONSTRUCTION SET

[75] Inventor: Don McCollum, Lee's Summit, Mo.

[73] Assignee: Steven Carl Pelluer, Littleton, Colo.

[21] Appl. No.: 936,091

[22] Filed: Aug. 26, 1992

[51] Int. Cl.[5] ..... A63H 33/08; A63H 33/12

[52] U.S. Cl. ..... 446/106; 446/108; 446/111; 446/122; 446/124

[58] Field of Search ..... 446/105, 106, 108, 111, 446/112, 113, 114, 115, 122, 124, 125

[56] References Cited

U.S. PATENT DOCUMENTS

| | | | |
|---|---|---|---|
| 1,271,160 | 7/1918 | Groves | 446/106 |
| 1,311,337 | 7/1919 | Fredson | 446/114 |
| 2,224,405 | 12/1940 | McIntyre | 446/106 |
| 2,319,914 | 5/1943 | Blanding, Jr. | 446/124 |
| 2,635,303 | 4/1953 | Poynter | 446/113 |
| 2,844,910 | 7/1958 | Korchak | 446/106 |
| 2,874,512 | 2/1959 | Joseph et al. | 446/106 |
| 3,007,279 | 11/1961 | Korchak | 446/106 |
| 3,023,890 | 3/1962 | Schollen | 446/106 |
| 3,473,277 | 10/1969 | Straight . | |
| 3,882,630 | 5/1975 | Bianco . | |
| 4,039,132 | 8/1977 | Fournier . | |
| 4,270,304 | 6/1981 | Sofer . | |
| 4,521,203 | 6/1985 | Rothenberg, Jr. | 446/106 |

FOREIGN PATENT DOCUMENTS

| | | | |
|---|---|---|---|
| 0538019 | 11/1955 | Belgium | 446/111 |
| 0937218 | 3/1948 | France | 446/124 |
| 7900567 | 8/1979 | PCT Int'l Appl. | 446/124 |
| 0486018 | 5/1938 | United Kingdom | 446/124 |

*Primary Examiner*—Robert A. Hafer
*Assistant Examiner*—Gregory M. Stone
*Attorney, Agent, or Firm*—Chase & Yakimo

[57] ABSTRACT

A construction kit for toy building structures includes a plurality of planar logs with opposed notches at the lateral ends thereof. The logs may be interconnected in a normal position by notch engagement or one atop the other by intermediate mounting plates. Roof logs and/or mounting plates utilize angularly positioned notches to mount logs in an angular relationship relative one to the other. Slider elements mount movable logs in a slidable relationship to a fixed log.

6 Claims, 4 Drawing Sheets

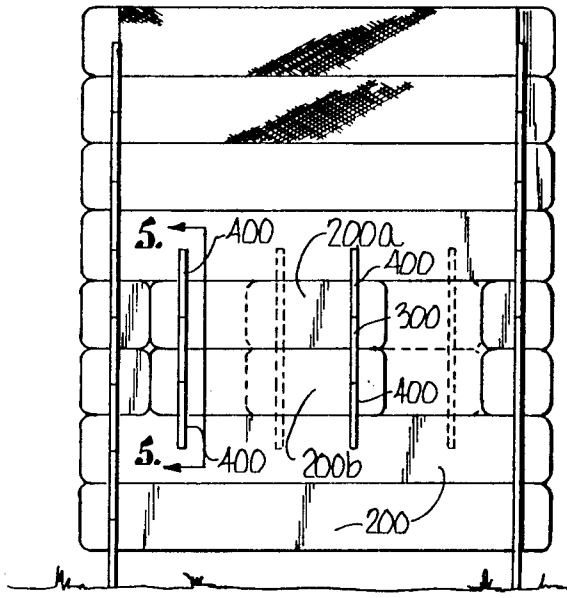
Fig. 5
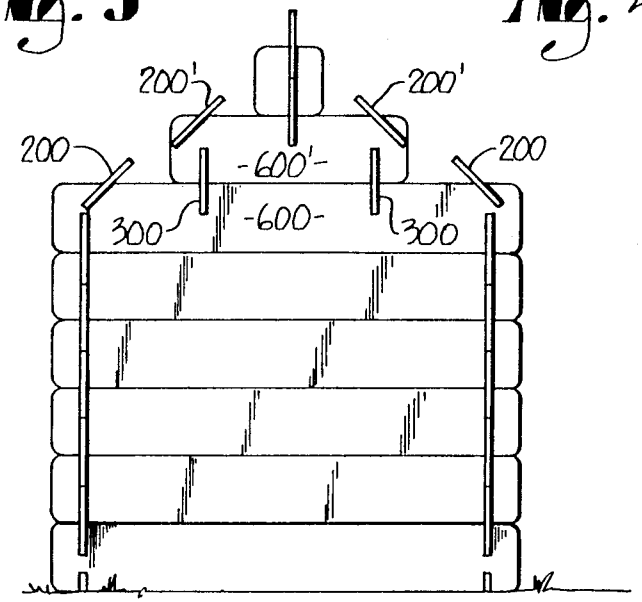
Fig. 4
Fig. 3
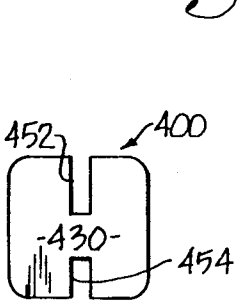
Fig. 9
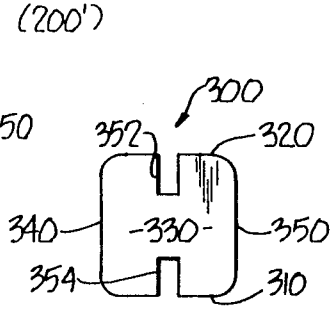
Fig. 8
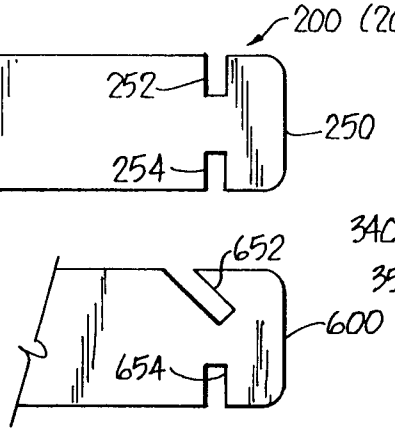
Fig. 7
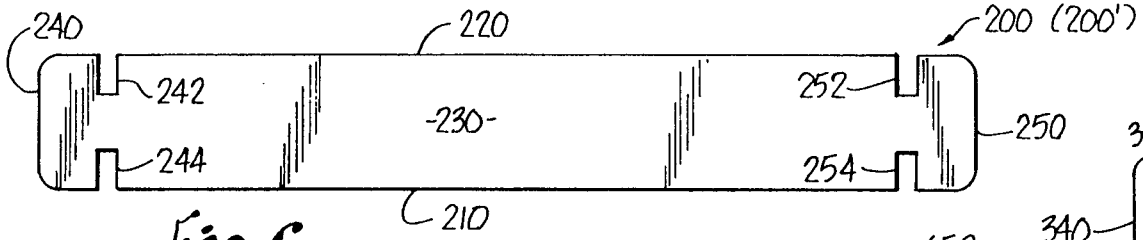
Fig. 6

CONSTRUCTION SET

BACKGROUND OF THE INVENTION

This invention relates to a construction set, and more particularly, to a toy building set having elements therein to build structures of selectable designs with slidable windows, doors and roofs.

Various building sets are known in the art having basic log-like or block-like elements to construct various structures. As most sets enable the user to build basic structures, manufacturers desire to introduce novel elements in such sets which allow various novel functions to be incorporated in the building design.

The present invention introduces a novel toy building set which presents a plurality of elongated, planar building logs intraconnected one to the other or by intermediate locking plates. The logs have upper and lower longitudinal edges with planar webs spanning therebetween. The ends of each log are defined by lateral edges. At the opposed ends of each log are a pair of opposed notches. Each vertical notch has a depth of approximately one-quarter of the width of each log for transverse engagement of a similar notch in another log or in the locking plate. A log likewise engages the opposed remaining notch in the log or mounting plate to allow for a flush mounting between the adjacent longitudinal edges of adjacent logs. A longitudinal sliding capability is Provided for doors and/or windows by means of slider elements similar in configuration to the locking plate. Each slider has a pair of opposed notches with the depth of one notch being one-fourth of the web width with the other notch having twice the depth of the other notch. Such a configuration allows the slider and an accompanying sliding log to be engaged to an adjacent fixed log in a flush slidable relationship therebetween. Roof logs present angled notches which allow for construction of a slanted roof along the top of the building proper.

It is therefore an object of this invention to provide a toy building set having interlocked planar logs therein.

It is another object of this invention to provide a building set, as aforesaid, which allows for construction of a slanted roof thereon.

A still further object of this invention is to provide a building set, as aforesaid, which has elements for mounting planar logs adjacent one another in a slidable over/under relationship therebetween.

Another particular object of this invention is to provide a building set, as aforesaid, having a plurality of planar logs which are interengageable so as to provide generally planar wall surfaces.

A still further object of this invention is to provide a building set which allows for a slidable relationship between fixed and movable logs.

Another particular object of this invention is to provide intermediate mounting plates in said building set, as aforesaid, which mounts the logs in a planar over/under relationship therebetween.

A further object of this invention is to provide a building set with mounting plates, as aforesaid, which mounts first and second planar logs in an angular relationship therebetween.

A further particular object of this invention is to provide a building set, as aforesaid, with the planar logs capable of being mounted in an angular relationship therebetween.

A further object of this invention is to provide a building set, as aforesaid, having a plurality of planar logs of various lengths which are capable of being mounted one to the other or by use of intermediate mounting plates.

Other objects and advantages of this invention will become apparent from the following description taken in connection with the accompanying drawings, wherein is set forth by way of illustration and example, an embodiment of this invention.

BRIEF DESCRIPTION OF THE DRAWINGS

FIG. 3 is a side elevation view of the building shown in FIG. 1 and illustrating in solid and phantom lines two positions of the slidable window therein.

FIG. 4 is a rear elevation view of the building shown in FIG. 1 with the flexible roof removed.

FIG. 5 is a partial sectional view on an enlarged scale, taken along line 5—5 in FIG. 3, illustrating the relationship of the locking plates and slider elements among the fixed and sliding logs.

FIG. 6 is a front view of a basic planar building log.

FIG. 7 is a fragmentary view of a basic planar building log for the roof of the building.

FIG. 8 is a front elevation view of a standard locking plate.

FIG. 9 is a front elevation view of a connecting slider.

DESCRIPTION OF THE PREFERRED EMBODIMENT

Figure 2:
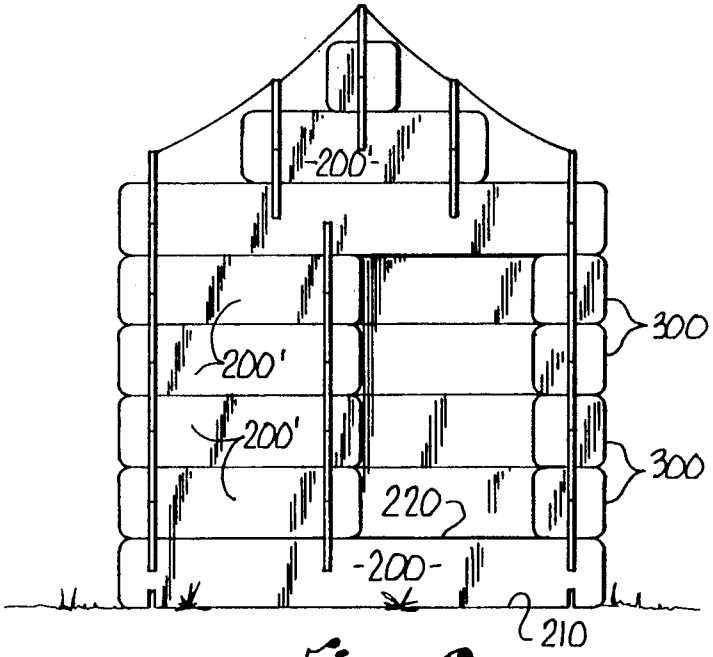
FIG. 2 is a front elevation view of the structure shown in FIG. 1.
Figure 1:
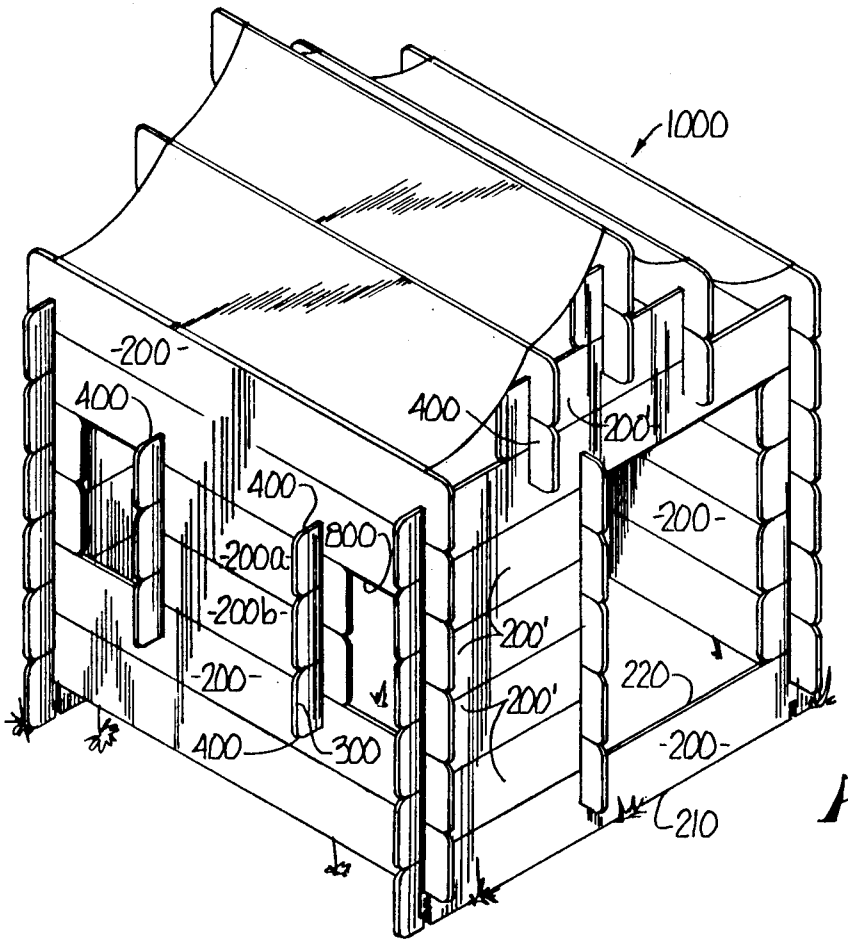
FIG. 1 is a perspective view of one building structure with a flexible material roof thereon, as constructed by utilizing the elements of the building set.
Figure 12:
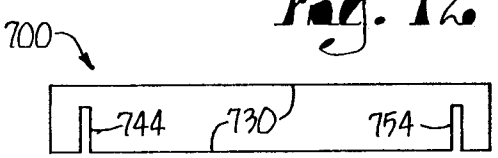
FIG. 12 is a plan view on a reduced scale of the alternative roof log used in FIG. 11.
Figure 13:
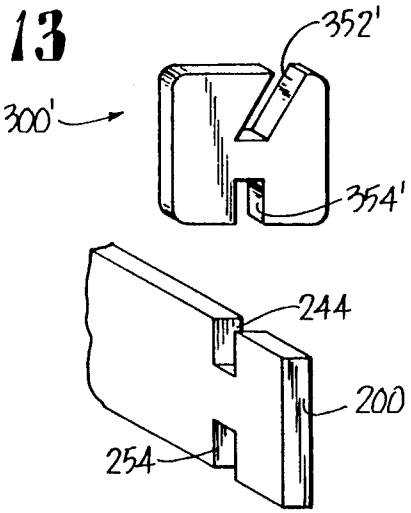
FIG. 13 is a perspective view showing the relationship between one end of an underlying building log and a mounting plate with angular notch prior to engagement.
Figure 10:
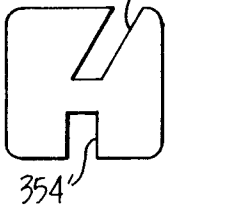
FIG. 10 is a view of an alternative mounting plate.

Turning more particularly to the drawings, FIG. 1 illustrates one building design 1000 utilizing the basic building elements of the construction set. As such the set comprises a plurality of elongated building logs of first 200 and second 200' dimensions either directly connected one to the other by means of locking notches or by means of intermediate mounting plates 300 as shown in FIG. 8.

As best shown in FIG. 6 each log 200, 200' comprises elongated, lower 210 and upper 220 longitudinal edges with a planar web 230 or wall spanning therebetween. Lateral, vertical edges 240, 250 define the ends of each log 200. As shown in FIG. 1, the logs 200, 200' may have various lengths so as to provide flexible designs which may be built using the construction set.

Each log 200 has a pair of opposed, locking notches 242, 244, 252, 254 adjacent the lateral edges 240, 250. Each notch has a depth of approximately one-fourth of the width of the web 230 spanning the longitudinal edges 210, 220. The basic building configuration is provided by transversely engaging an upper notch 242, 252 of each log with a lower notch 244, 254 of another log 200. Upon such locking engagement the notch configuration positions the lower edge 210 of an upper 200 log normal to a midpoint between the notches of the lower log. Likewise the upper edge 220 of the lower log is normal to the midpoint between the notches of the upper log. This notch configuration and log engagement causes the lower edge 210 of a subsequent log to lie contiguous to the upper edge 220 of the log therebelow so as to provide an uninterrupted vertical wall surface as provided by the plurality of webs 230 mounted one atop the other.

An alternative engagement of adjacent logs is provided by means of intermediate locking plates 300 as shown in FIG. 8. Each locking plate 300 presents lower 310 and upper longitudinal 320 edges with lateral edges 340, 350 spanning therebetween. A pair of opposed notches 352, 354 are provided in the web 330 of each plate with web 330 being equal to that of web 230 of log 200. The depth of said notches are approximately one-fourth that of web 330 and are thus equal to the depth of the notches 242, 244, 252, 254 found at each end of the basic building log.

As illustrated, the mounting plate 300 allows for the connection of logs 200, 200' of various lengths in an over/under relationship therebetween. Due to the congruent configuration among the notches the upper longitudinal edge 220 of a lower log 200 is normal to the plate 300 at the medial point of the web 330 between the notches 352, 354. Thus, when the lower notch 244 or 254 of a subsequent log 200 engages the upper notch 352 of the locking plate 300, the lower longitudinal edge 210 of the upper log 200' will lie normal to the mid-point of web 330. Edge 210 will also be adjacent the upper, longitudinal edge 220 of the lower log 200. This relationship allows for interengagement of the logs of various lengths 200, 200' one to the other by mounting plate 300 while allowing for a contiguous mounting between the adjacent upper and lower edges of the adjacent logs 200, 200'. This contiguousness maintains a flush alignment of the webs 230 of each log.

As also shown in FIGS. 1 and 3 of the drawings, a sliding capability is provided between fixed logs 200 and adjacent sliding logs 200*a*, 200*b*. As shown in FIGS. 1, 3 and 5, the window includes two logs 200*a*, 200*b* which slide along the extent of the window opening 800. The sliding capability is provided by a combination of slider elements 400, locking plates 300 and the logs 200*a*, 200*b*.

In order to provide a flush mounting of the longitudinal edges of the sliding logs 200*a*, 200*b* adjacent the upper and lower fixed logs 200, sliders 400, as shown in FIG. 9, are provided. Each slider is similar in configuration to mounting plate 300 with a pair of opposed notches 452, 454. As shown in FIG. 9 one notch 452 of the slider 400 is approximately twice the length of the opposed notch 454 with notch 454 being one-fourth of the distance of the web 430. The elongated notch 452 is designed to engage the fixed upper and/or lower logs 200. The notch 454 transversely engages the notches of the slidable log 200*a* or 200*b*. The relationship of elongated notch 452 with the web of the fixed log 200 enables the edges of the sliding logs 200*a*, 200*b* to be positioned adjacent the edges 220, 210 of the lower and upper fixed logs 200. As the notches of the slidable logs 200*a*, 200*b* transversely engage the notches 454, movement of sliders 400 along the webs 230 of fixed logs 200 concurrently move the logs 200*a*, 200*b* fixed thereto.

This relationship is best shown in FIG. 5. As such, the notches 352, 354 of the intermediate mounting plate 300 engage the upper and lower notches of sliding logs 200*a*, 200*b*. The relative one-fourth depth of the notches in the sliding logs 200*a*, 200*b* provide for contiguous fit between the edges of the upper log 200*a* and lower log 200*b*. The elongated notches 452 of the slider elements 400 slidably engage the webs 230 of the upper and lower, fixed logs 200. As such, the sliding logs 200*a*, 200*b* are in a contiguous, slidable relationship one to the other and in a flush, slidable relationship with the upper and lower, fixed logs 200. This later contiguousness is provided by the extended notches 452. Slider 400 may also be used as a fixed mounting plate as shown in FIG. 1.

Also, as shown in FIG. 7, roof logs 600 are provided. Each roof log 600 has a slanted notch 652 at a lateral end thereof and a normal vertical notch 654. The vertical notch 654 transversely engages the upper, free notch 252 of a log 300 at the top of the building (FIG. 4). As such the slanted notch 652 can then transversely engage the regular, lower notches 244, 254 of a subsequent log 200. Upon such engagement the subsequent log 200 is angularly positioned relative to the underlying vertical log 600 as shown in FIGS. 4 and 7. Mounting plates 300 can then engage the upper notches 242, 252 of each log 200. Subsequent logs 200 can then engage said mounting plates 300. This combination can be repeated to form the roof line.

Figure 11:
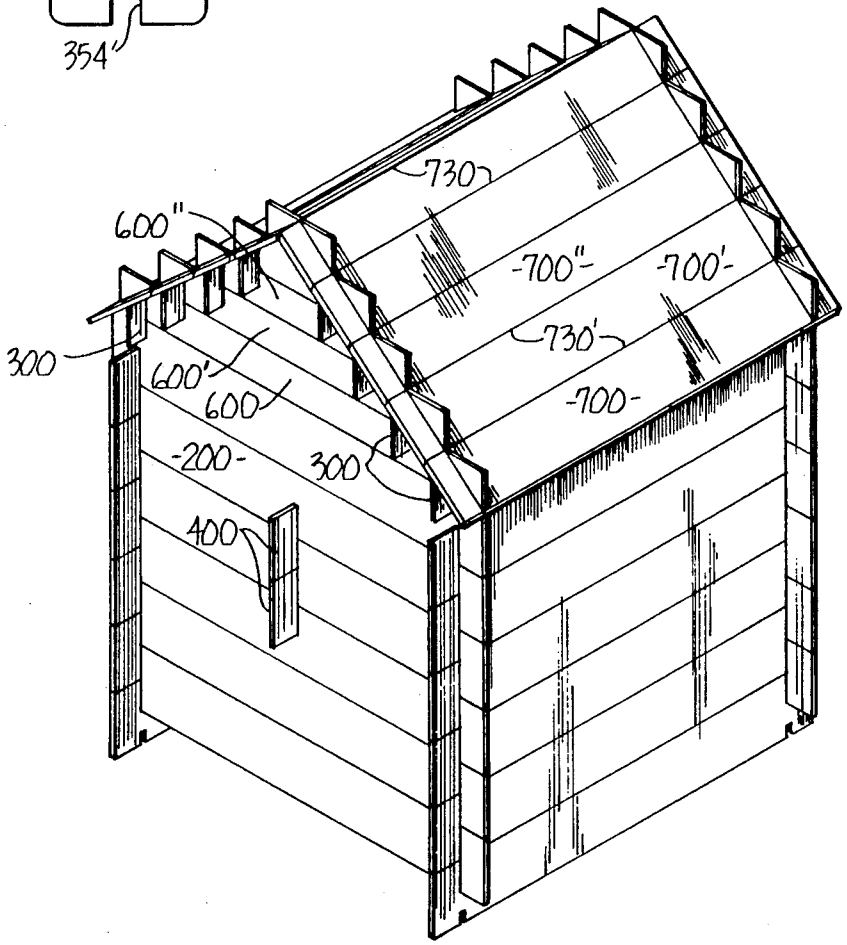
FIG. 11 is a perspective view of a structure utilizing alternative roof logs.
Figure 15:
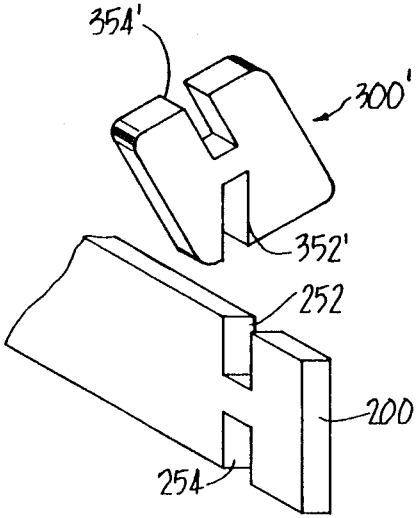
FIG. 15 is a perspective view showing the relationship between an end of an underlying building log and the angular notch of the FIG. 13 mounting plate prior to engagement.
Figure 17:
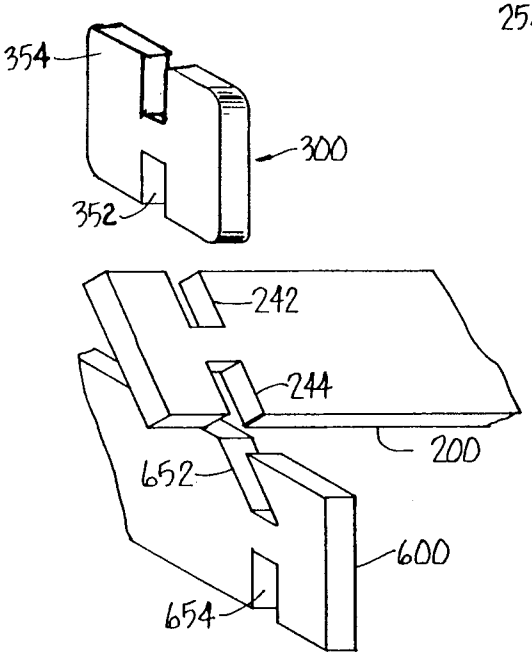
FIG. 17 shows the relationship among an end of an underlying building log with slanted notch, an end of an intermediate building log with normal notch and mounting plate prior to engagement.
Figure 14:
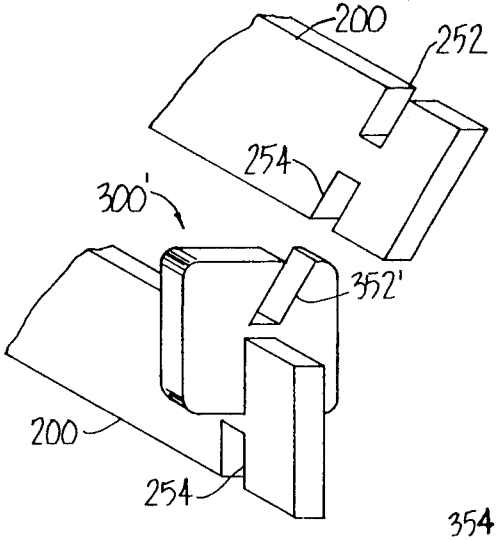
FIG. 14 is a perspective view showing the engagement of the elements of FIG. 13 and further showing the relationship between the underlying mounting late and an end of an overlying building log prior to engagement.
Figure 16:
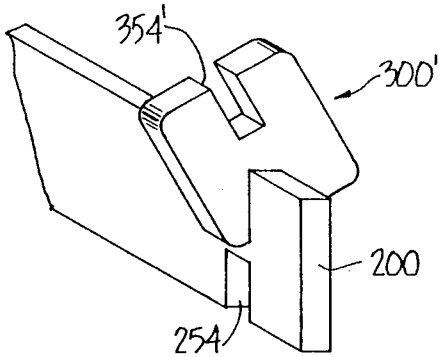
FIG. 16 is a perspective view showing the engagement of the elements of FIG 15.

Alternatively, a slanted roof surface may be constructed by the use of roof logs 700 as shown in FIG. 11. As above described, a roof mounting log 600 (FIG. 7) is attached atop a log 200 by means of notches 654 transversely engaging the upper notches 242 of log 200. Each roof log 700 has only two lower notches 744, 754 which engages the slanted notches 652 found in each roof mounting log 600. A subsequent roof log 600' is mounted atop the lower log 600 by means of plates 300. The slanted notches 652' of a subsequently higher log 600' are aligned with the notches 652 of the lower log 600. Accordingly, upon roof log 700' engaging the slanted notches 652, the web 730' of log 700' will align with the web 730 of log 700. Accordingly, subsequent smaller logs 600'' can be mounted atop each other and the above process repeated. It is noted that the roof logs 600, 600', 600'', etc. become smaller in length so that the angular notches 652 are interaligned. This alignment allows for the planar relationship among logs 700.

It is also understood that the mounting plates 300' (FIGS. 10, 13–16) may have such angular notches 352'. Upon engagement with the underlying log 200 the angular notch will initially direct an engaged log 200 into a desired angular relationship. Alternatively, the angular notch 352' may engage the underlying log. This engagement will direct the normal notch 354' into an angled relationship relative to the log. This upper, slanted notch is engaged by the lower notch 244, 254 of the subsequent log 200. As such, the plurality of logs 200 may be interconnected in a slanted relationship by the mounting plates 300, 300'. Thus, the logs 200 may be interconnected one to the other by plates 300, 300' to form a planar roof line.

It is to be understood that while certain forms of this invention have been illustrated and described, it is not limited thereto except insofar as such limitations are included in the following claims and allowable functional equivalents thereof.

Having thus described the invention what is claimed as new and desired to be secured by Letters Patent is as follows:

1. A construction kit for creating structures comprising:

a plurality of first building logs of a first dimension having a pair or opposed, upper and lower, longitudinal edges and a pair of opposed, lateral edges with a planar web spanning said edges, said web having a length of a first dimension;

a plurality of second building logs having a generally planar web of a width equal to said first log web and a length less than said first web length, said second logs having a pair of opposed, longitudinal edges and a pair of opposed, lateral edges;

a pair of opposed, upper and lower notches found in each of said webs at the lateral edges of each of said first and second logs, each notch having a depth of approximately one-quarter of the width of each web, said notch of one of said logs transversely engageable with a notch of another log with one of said edges of each engaged log positioned normal to said web of the other log at the midpoint thereof;

a plurality of first mounting plates having a pair of opposed, longitudinal edges and a pair of opposed, lateral edges with a web spanning said edges, said web having a width equal to the width of said first and second webs;

a pair of opposed, upper and lower notches in said mounting plate web, said notches congruent to the other notches in said first and second webs, said lower notch of said mounting plate transversely engaging an upper notch of one of said logs to present said upper notch on said mounting plate for engagement with a notch of one of said logs whereby to mount a pair of logs in a planar over-/under relationship therebetween;

a slider element having a pair of opposed, longitudinal and lateral edges with a web therebetween, said web equal in width to the other of said webs;

a pair of opposed, upper and lower notches in said slider element with one of said notches being a notch generally one-fourth the distance of said web and the other notch being a relatively longer notch generally twice the length of said first shorter notch, said longer notch transversely engaging a portion of a web of an adjacent building log with the shorter notch of said slider element transversely engaging a notch in one of said other building logs whereby to provide a slidable relationship between said building logs engaging said notches of said slider element.

2. The device as claimed in claim 1 further comprising:

a plurality of third building logs having a pair of opposed, upper and lower, longitudinal edges and a pair of opposed, lateral edges with a planar web spanning said edges, said web having a width equal to the width of the other of said webs;

a pair of opposed, upper and lower notches on each web at the lateral edges of each third log, at least one of said notches of each pair of notches having an angular relationship to one of said longitudinal edges, said lower notch engaging a notch of one of said building logs to position the other of said notches in an angular position relative to said one log, said other notch providing for an engagement with a notch of another of said building logs whereby to position one of said logs in an angular relationship relative to another of said logs.

3. The apparatus as claimed in claim 2 wherein one of said notches in said mounting plates engage said notch of said angularly positioned log, said engagement presenting the other of said notches of said mounting plate for engagement with one of said building log notches to position the same in a planar relationship with the adjacent log.

4. The apparatus as claimed in claim 2 further comprising:

a plurality of second mounting plates having a pair of opposed, longitudinal edges and a pair of opposed, lateral edges with a web spanning said edges, said web having a width equal to the width of said other web;

a pair of opposed, upper and lower notches in said second mounting plate web, one of said notches being in an angular relationship relative to the adjacent longitudinal edge with said other of said notches being normal to a longitudinal edge, one of said notches engaging one of said notches of a log to position said other angle notch of said second mounting plates in an angular position relative to said log.

5. A structure construction kit comprising:

a plurality of first building logs of a first dimension having a pair of opposed, upper and lower, longitudinal edges and a pair of opposed, lateral edges with a planar web spanning said edges, said web having a length of a first dimension;

a plurality of second building logs having a web of a width equal to said first log web and a length less than said first web length, said second logs having a pair of opposed, longitudinal edges and a pair of opposed, lateral edges;

a pair of opposed, upper and lower notches found in each of said webs at the lateral edges of each of said first and second logs, each notch having a depth of approximately one-quarter of the width of each web, said notch of one of said logs transversely engageable with a notch of another log with one of said edges of each engaged log positioned normal to said web of the other log at the midpoint thereof;

a plurality of first mounting plates having a pair of opposed, longitudinal edges and a pair of opposed, lateral edges with a web spanning said edges, said web having a width equal to the width of said first and second webs;

a pair of opposed, upper and lower notches in said mounting plate web, said notches congruent to the other notches in said first and second webs, said lower notch of said mounting plate transversely engaging an upper notch of one of said logs to present said upper notch on said mounting plate for engagement with a lower notch of another one of said logs whereby to mount a pair of logs in a planar over/under relationship therebetween;

a plurality of third building logs having a pair of opposed, upper and lower, longitudinal edges and a pair of opposed, lateral edges with a planar web spanning said edges, said web having a width equal to the width of the other of said webs;

a pair of opposed, upper and lower notches in each web at the lateral edges of each third log, each pair of upper notches having an angular relationship to one of said longitudinal edges, said lower notches transversely engaging upper notches of one of said lower building logs to position the upper notches of said third log in an angular position relative to said lower log, said upper notches providing for an engagement with lower notches of another of said building logs whereby to position said engaged building log in an angular relationship relative to said third building log;

one of said notches in said first mounting plates engages the upper notches of said engaged building log, said engagement presenting the other of said notches of said mounting plate for engagement wit the notches of another subsequent building log whereby to position said subsequent building log in a planar relationship with the adjacent engaged building log.

6. A structure construction kit comprising:

a plurality of first building logs of a first dimension having a pair of opposed, upper and lower, longitudinal edges and a pair of opposed, lateral edges with a planar web spanning said edges, said web having a length of a first dimension;

a plurality of second building logs having a web of a width equal to said first log web and a length less than said first web length, said second logs having a pair of opposed, longitudinal edges and a pair of opposed, lateral edges;

a pair of opposed, upper and lower notches found in each of said webs at the lateral edges of each of said first and second logs, each notch having a depth of approximately one-quarter of the width of each web, said notch of one of said logs transversely engageable with a notch of another log with one of said edges of each engaged log positioned normal to said web of the other log at the midpoint thereof;

a plurality of first mounting plates having a pair of opposed, longitudinal edges and a pair of opposed, lateral edges with a web spanning said edges, said web having a width equal to the width of said first and second webs;

a pair of opposed, upper and lower notches in said mounting plate web, said notches congruent to the other notches in said first and second webs, said lower notch of said mounting plate transversely engaging an upper notch of one of said logs to present said upper notch on said mounting plate for engagement with a notch of one of said logs whereby to mount a pair of logs in a planar over-/under relationship therebetween;

a plurality of third building logs having a pair of opposed, upper and lower, longitudinal edges and a pair of opposed, lateral edges with a planar web spanning said edges, said web having a width equal to the width of the other of said webs;

a pair of opposed, upper and lower notches in each web at the lateral edges of each third log, each pair of upper notches having an angular relationship to one of said longitudinal edges, said lower notches transversely engaging upper notches of one of said lower building logs to position the upper notches of said third log in an angular position relative to said lower log, said upper notches providing for an engagement with lower notches of another of said building logs whereby to position said engaged building logs in an angular relationship relative to said third building log;

a plurality of second mounting plates having a pair of opposed, longitudinal edges, and a pair of opposed, lateral edges with a web spanning said edges, said web having a width equal to the width of said other web;

a pair of opposed, upper and lower notches in said second mounting plate web, one of said notches being in an angular relationship relative to the adjacent longitudinal edge with said other of said notches being normal to a longitudinal edge, one of said notches engaging one of said notches of a log to position said mounting plate in an angular position relative to said log for subsequent engagement with a building log.

* * * * *

UNITED STATES PATENT AND TRADEMARK OFFICE

CERTIFICATE OF CORRECTION

PATENT NO. : 5,281,181

DATED : January 25, 1994

INVENTOR(S) : DON MCCOLLUM

It is certified that error appears in the above-identified patent and that said Letters Patent is hereby corrected as shown below:

Column 2, line 45, delete "late" and substitute --plate--.

Column 4, line 67, after "log" insert --(Figs. 15, 16)--.

Column 7, line 23, delete "wit" and substitute --with--.

Signed and Sealed this

Fourteenth Day of June, 1994

Bruce Lehman

*Attest:*

BRUCE LEHMAN

*Attesting Officer*

*Commissioner of Patents and Trademarks*